US009069995B1

(12) United States Patent
Cronie

(10) Patent No.: US 9,069,995 B1
(45) Date of Patent: Jun. 30, 2015

(54) MULTIPLY ACCUMULATE OPERATIONS IN THE ANALOG DOMAIN

(71) Applicant: KANDOU LABS, S.A., Lausanne (CH)

(72) Inventor: Harm Cronie, Lausanne (CH)

(73) Assignee: KANDOU LABS, S.A. (CH)

( * ) Notice: Subject to any disclaimer, the term of this patent is extended or adjusted under 35 U.S.C. 154(b) by 227 days.

(21) Appl. No.: 13/773,066

(22) Filed: Feb. 21, 2013

(51) Int. Cl.
*G06G 7/16* (2006.01)

(52) U.S. Cl.
CPC ..... *G06G 7/16* (2013.01)

(58) Field of Classification Search
CPC ..... G06G 7/16; G06G 7/163; G06G 7/161; G06G 7/164; G06E 3/005
USPC ..... 708/835
See application file for complete search history.

(56) References Cited

U.S. PATENT DOCUMENTS 5,619,444 A 4/1997 Agranat
5,724,000 A * 3/1998 Quinn ..... 327/554

* cited by examiner

*Primary Examiner* — Tan V. Mai
(74) *Attorney, Agent, or Firm* — Invention Mine LCC.

(57) ABSTRACT

Fixed capacitive circuits are described which perform arithmetical summation operations over sets of scaled analog values, where the constant parameters of the summations and scaling multiplications are formed as ratios of circuit element values. The passive nature of the design can enable efficient integrated circuit implementation.

20 Claims, 12 Drawing Sheets

MULTIPLY ACCUMULATE OPERATIONS IN THE ANALOG DOMAIN

FIELD OF THE INVENTION

The present invention relates to analog multiplication units and to units for performing signal processing operations in the analog domain.

BACKGROUND OF THE INVENTION

In some signal processing algorithms, basic operations include multiplications and additions. These operations are typically performed in the digital domain by a digital signal processor (DSP), central processing unit (CPU) or custom digital logic, operating on numeric digital data obtained by measurement of the original analog values. One digital logic element commonly incorporated in such operations is a multiply-accumulate unit or MAU, as known to those of skill in the art.

Among other uses, multiply accumulate units can be useful to implement matrix vector multipliers with which general linear transformations, such as for instance the discrete Fourier transform (DFT), can be implemented. Furthermore, multiply accumulate units can be used to implement finite impulse response filters (FIRs).

In communication systems such as wireless networks and digital subscriber line (DSL) links, sophisticated signal processing algorithms can be used to perform tasks such as channel equalization, synchronization and error-correction. In several of these systems the operation of equalization is performed by a linear operation. An example is the use of orthogonal frequency division multiplexing in wireless systems, and discrete-multi tone (DMT) in DSL systems.

In some communication systems, the speed is sufficiently high or the power budget sufficiently low that the use of digital logic to perform the required signal processing operations is prohibitively complex. Conventional attempts to overcome such problems are inefficient, ineffective and/or have undesirable side effects or other drawbacks with respect to at least one significant use case.

Embodiments of the invention are directed toward solving these and other problems individually and collectively.

BRIEF SUMMARY OF THE INVENTION

An analog circuit including a network of fixed capacitors may perform a set of multiplications and additions to implement a multiply accumulate unit. An apparatus for multiply accumulate operations may include multiple circuit inputs configured to receive multiple input voltages. The input voltages may correspond to input values of a multiply accumulate operation. The apparatus may further include one or more circuit outputs configured to provide one or more output voltages. The one or more output voltages may correspond to one or more results of the multiply accumulate operation. The apparatus may further include a capacitor network coupled with the circuit inputs and the one or more circuit outputs. The capacitor network may include multiple sets of fixed capacitors. Each of a first set of fixed capacitors may be configured to receive, at an input terminal, a voltage corresponding to one of the input values of the multiply accumulate operation. Input terminals of a second set of fixed capacitors may be coupled with output terminals of the first set such that the one or more output voltages provided at the one or more circuit outputs correspond to one or more results of the multiply accumulate operation.

Embodiments of the invention covered by this patent are defined by the claims below, not this brief summary. This brief summary is a high-level overview of various aspects of the invention and introduces some of the concepts that are further described in the Detailed Description section below. This brief summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
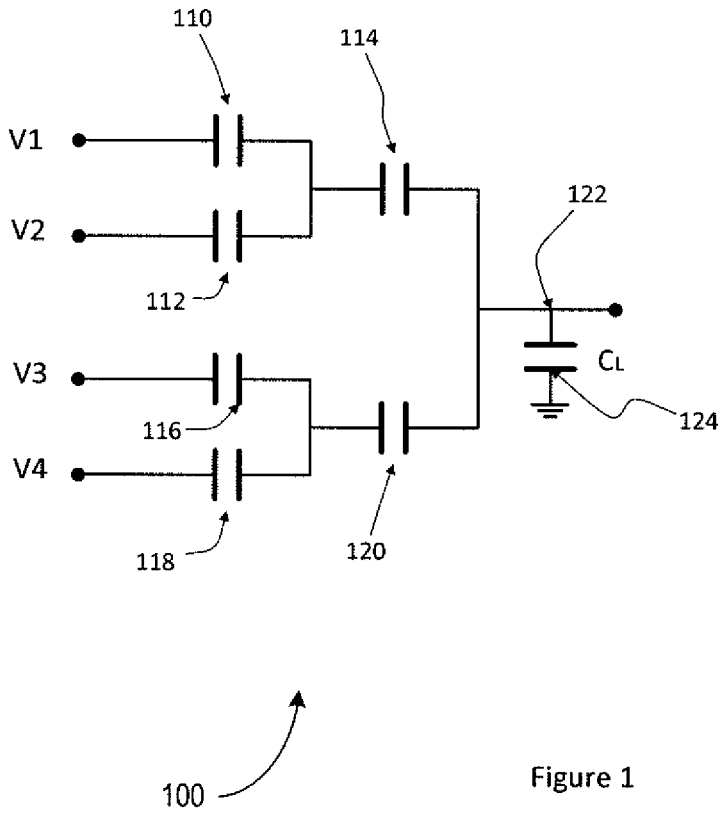
FIG. 1 is a schematic diagram showing an example analog circuit in accordance with at least one embodiment of the invention.

As appreciated by the present inventors, in a number of applications utilizing multiply accumulate (MAC) operations (e.g., operations in which input signals such as direct current voltages are multiplied by scalars and/or additively combined), the coefficients of the multiplications are pre-determined constants. For example, the term coefficients of a pulse-amplitude modulation (PAM) modulator may be computed in advance, and the actual modulator may thus utilize multiplication of input values by each of these pre-computed values, followed by the accumulation operation. In accordance with at least one embodiment of the invention, FIG. 1 shows an example analog circuit 100. The example circuit 100 is based on a network of fixed capacitors that performs a set of multiplications and additions as required for a multiply accumulate unit (MAU). The inputs to the MAU 100 are $V_1$, $V_2$, $V_3$ and $V_4$ and the output is given by:

$$V = \frac{1}{Z}(b_1(c_1V_1 + c_2V_2) + b_2(c_3V_3 + c_4V_4)) \quad \text{[Equation 1]}$$

The coefficients $c_1$, $c_2$, $c_3$, $c_4$, $b_1$, $b_2$ and scale factor Z are set by the values of the capacitors and are described in more detail below. The MAU 100 includes capacitors 110, 112, 116 and 118 that are connected to input voltages $V_1$, $V_2$, $V_3$ and $V_4$. The capacitances of capacitors 110, 112, 116 and 118 (the input set of capacitors) are $C_1$, $C_2$, $C_3$ and $C_4$, respectively. One of the terminals of capacitors 110, 112, 116, 118 is connected to one of the inputs and the other terminal is connected to a terminal of capacitor 114, 120. Each capacitor 114, 120 is communicatively coupled with a disjoint set of the input set of capacitors. The capacitances of 114 and 120 are denoted by $D_1$, $D_2$ respectively. The output is node 122 and the voltage at this node is denoted by the V of Equation 1. An additional load capacitor 124 with capacitance $C_L$ is assumed for the output node, which may be a component of the load or the result of parasitic capacitance.

In accordance with at least one embodiment of the invention, capacitances $C_1$, $C_2$ and $C_3$, $C_4$ (corresponding to the disjoint sets) are chosen as $C_1+C_2=C$ and $C_3+C_4=C$. Furthermore capacitances $D_1$ and $D_2$ are chosen as $D_1=a_1C$ and $D_2=a_2C$, where $a_1$ and $a_2$ are corresponding ratios. That is, the value C is a base capacitance to which other capacitances are referred proportionately or ratiometrically.

To explain the operation of the circuit 100 further, it is assumed that the main circuit operation takes place at a time t=0 and that the output voltage V is initialized to 0 Volts at t<0. Furthermore, it is assumed that the inputs $V_1$, $V_2$, $V_3$ and $V_4$ are equal to 0 for t<0 and attain their value at t=0. At t=0 the inputs $V_1$, $V_2$, $V_3$ and $V_4$ attain their value and the output V becomes $$V = \frac{1}{Z}\left(\frac{a_1}{1+a_1}(C_1V_1 + C_2V_2) + \frac{a_2}{1+a_2}(C_3V_3 + C_4V_4)\right). \quad \text{[Equation 2]}$$

The scale factor Z is given by $$Z = C_L + \left(\frac{a_1}{1+a_1} + \frac{a_2}{1+a_2}\right)C, \quad \text{[Equation 3]}$$

and has the effect of scaling the output voltage. The relation between the coefficients $c_1$, $c_2$, $c_3$, $c_4$, $b_1$, $b_2$ of Equation 1 and coefficients $a_1$, $a_2$ and capacitances $C_1$, $C_2$, $C_3$ and $C_4$ of Equation 2 is:

$$b_1 = \frac{a_1}{1+a_1},\ b_2 = \frac{a_2}{1+a_2} \quad \text{[Equation 4]}$$
$$c_1 = C_1,\ c_2 = C_2,\ c_3 = C_3,\ c_4 = C_4$$

In accordance with at least one embodiment of the invention the values of $a_1$ and $a_2$ are real numbers in the range of [0,1]. In this case, the contribution to the output V as given by $b_1$ and $b_2$ takes a value in the range [0,0.5].

In accordance with at least one embodiment of the invention a series of multiplications and additions according to Equation 1 is performed where $c_1$, $c_2$, $c_3$, $c_4$ are chosen in the range [0,1] and $b_1$ and $b_2$ are chosen in the range [0,0.5]. This may be accomplished by scaling the original coefficients to fall in the ranges given. As will be apparent to one of skill in the art, this restriction to a particular range should in no way be interpreted as limiting. It does give rise to a simple and efficient implementation but other possibilities exist. The multiply accumulate operation may be performed in accordance with at least one embodiment of the invention as exemplified in FIG. 1, by choosing the capacitor values $C_i=c_iC$ for i=1, . . . , 4 and choosing the capacitor values $D_1$ and $D_2$ as:

$$D_1 = \frac{b_1}{1-b_1}C,\ D_2 = \frac{b_2}{1-b_2}C \quad \text{[Equation 5]}$$

Some applications may add additional circuitry to counter the effect of scaling by Z, using as one example a high input impedance fixed gain amplifier following the MAU output node 122.

Thus, the example shown in FIG. 1 and generally described by Equation 1 implements the sum-of-products function expected of a MAU, with each input $V_1$, $V_2$, $V_3$ and $V_4$ multiplied or scaled by a predetermined coefficient $c_1$, $c_2$, $c_3$, $c_4$ and the results summed proportionate to individual coefficients $b_1$, $b_2$ and overall scale factor Z. The capacitors 114 and 120 are examples of summation nodes in the capacitor network 100. In a capacitor network, such as the capacitor network 100, network nodes correspond to capacitors. In accordance with at least one embodiment of the invention, capacitors may have an input terminal and an output terminal. The input terminal of a capacitor in the capacitor network may be communicatively coupled (e.g., electronically connected) with one or more output terminals of other capacitors in the capacitor network. The capacitor network 100 provides a weighted sum of a subset of the input voltage signals to each summation node, and the output of the capacitor network 100 is, further, a weighted sum of those weighted sums. In accordance with at least one embodiment of the invention, input values of a MAC operation are distinct from input voltage signals to a MAU in at least that, as will be appreciated by one of skill in the art, a set of input values may be encoded with a set of input voltage signals with one or more suitable encoding techniques. The weights may be determined by fixed capacitance values of the fixed capacitors in the capacitor network 100. The multiply accumulate unit uses passive components, so operation can be very fast and linear. Very low power operation can be achieved, and the passive nature facilitates operation even in systems using very low supply voltage. Only ratiometric or proportional capacitor values are required, allowing efficient implementation within an integrated circuit, for example, where obtaining accurate ratios of capacitance values may be easy, but obtaining absolute capacitive values may not.

Figure 2:
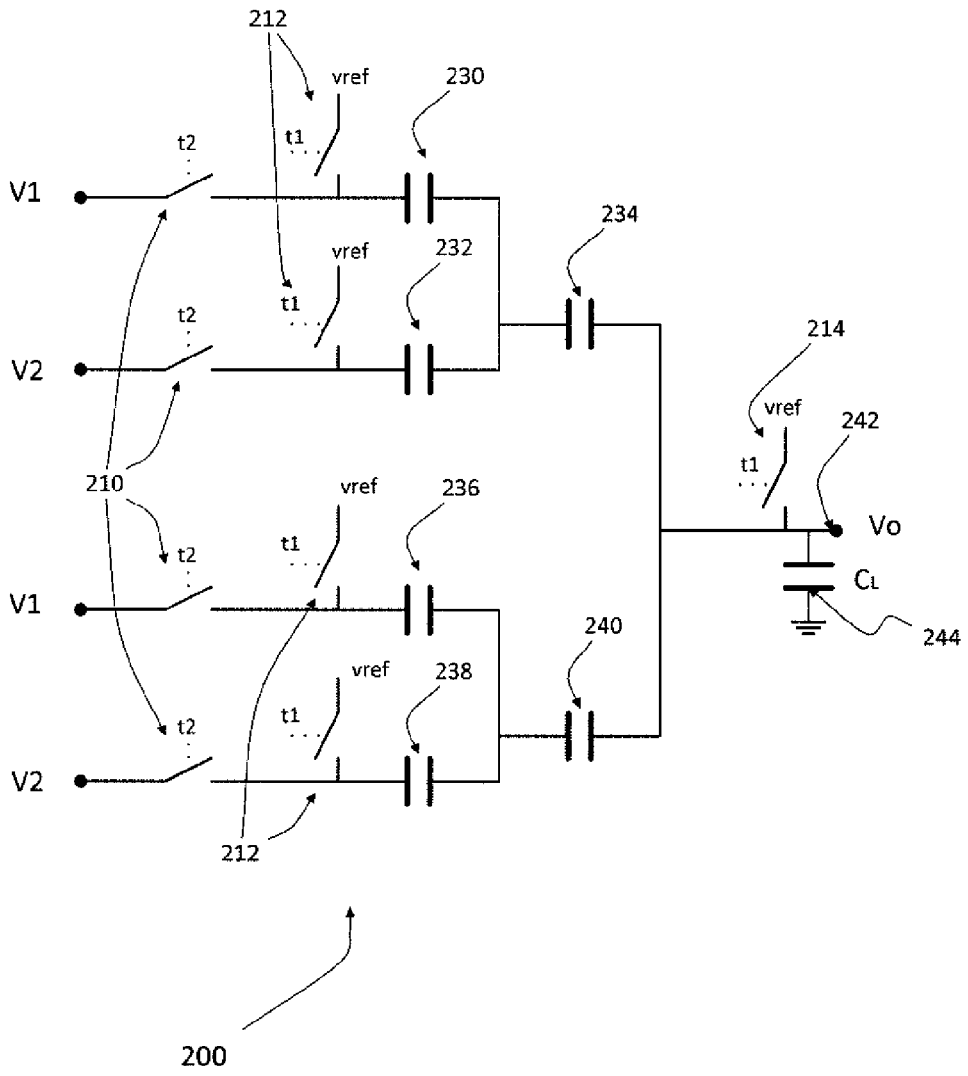
FIG. 2 is a schematic diagram showing an example analog circuit including pre-charge circuitry in accordance with at least one embodiment of the invention.
Figure 3:
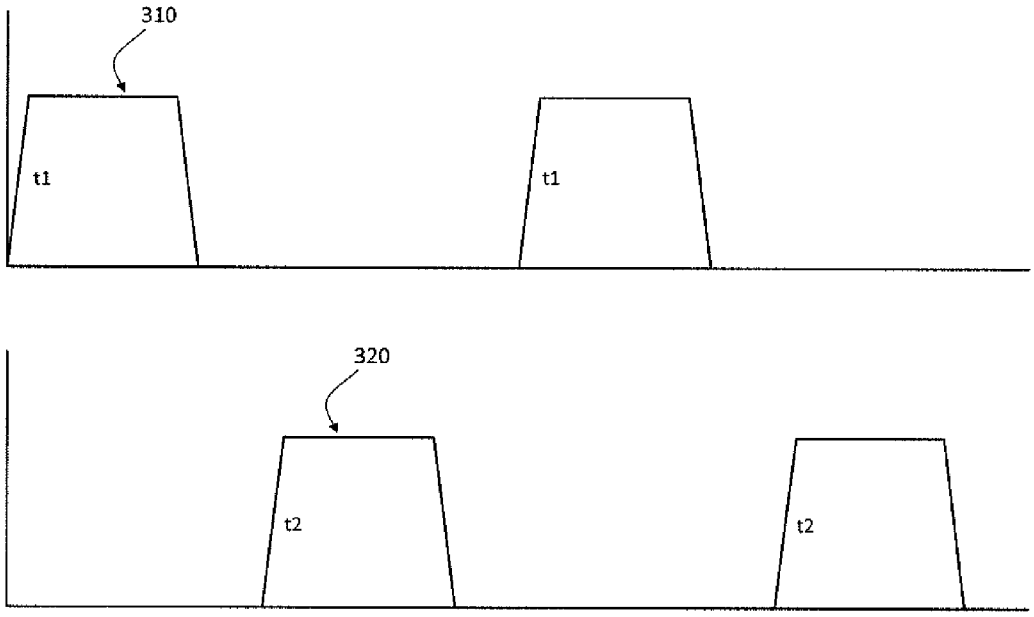
FIG. 3 is a timing diagram corresponding to an example operation of the circuit of FIG. 2.

In accordance with at least one embodiment of the invention FIG. 2 shows an example circuit 200 with pre-charge circuitry to allow for successive computations of a multiply accumulate operation. For this purpose a switch 214 is connected to the output node. At period time instances $t_1$ switch 214 is closed and output node 242 is connected to a reference voltage of vref. This pre-charges the output node to a voltage of vref. Components 230, 232, 234, 236, 238, 240, 242 and 244 of FIG. 2 correspond to components 110, 112, 114, 116, 118, 120, 122 and 124 of FIG. 1, respectively. In a similar way the left plate in FIG. 2 of capacitors 230, 232, 236, 238 is connected to a switch and at the periodic time instances $t_1$ this left plate of capacitors 230, 232, 236, 238 is connected to vrefby switches 212. Note that the value of vref of the left plate of capacitors 230, 232, 236, 238 is not necessarily equal to the value of vref of the output node 242. At a periodic time instance $t_2$ the switches 212 are opened and switches 210 are closed which connects the inputs $V_1$, $V_2$, $V_3$ and $V_4$ to the capacitors 230, 232, 236, 238. This initiates a charges redistribution and the multiply accumulate operation is performed. An example timing diagram illustrating the period time instances $t_1$ and $t_2$ is shown in FIG. 3. When the waveform 310 is high the switches 214 and 212 are closed and when the waveform 310 is low the switches 214,212 are open. When waveform 320 is high, switches 210 are closed and when waveform 320 is low switches 210 are open. In accordance with at least one embodiment of the invention, waveforms 310 and 320 may be non-overlapping.

Figure 4:
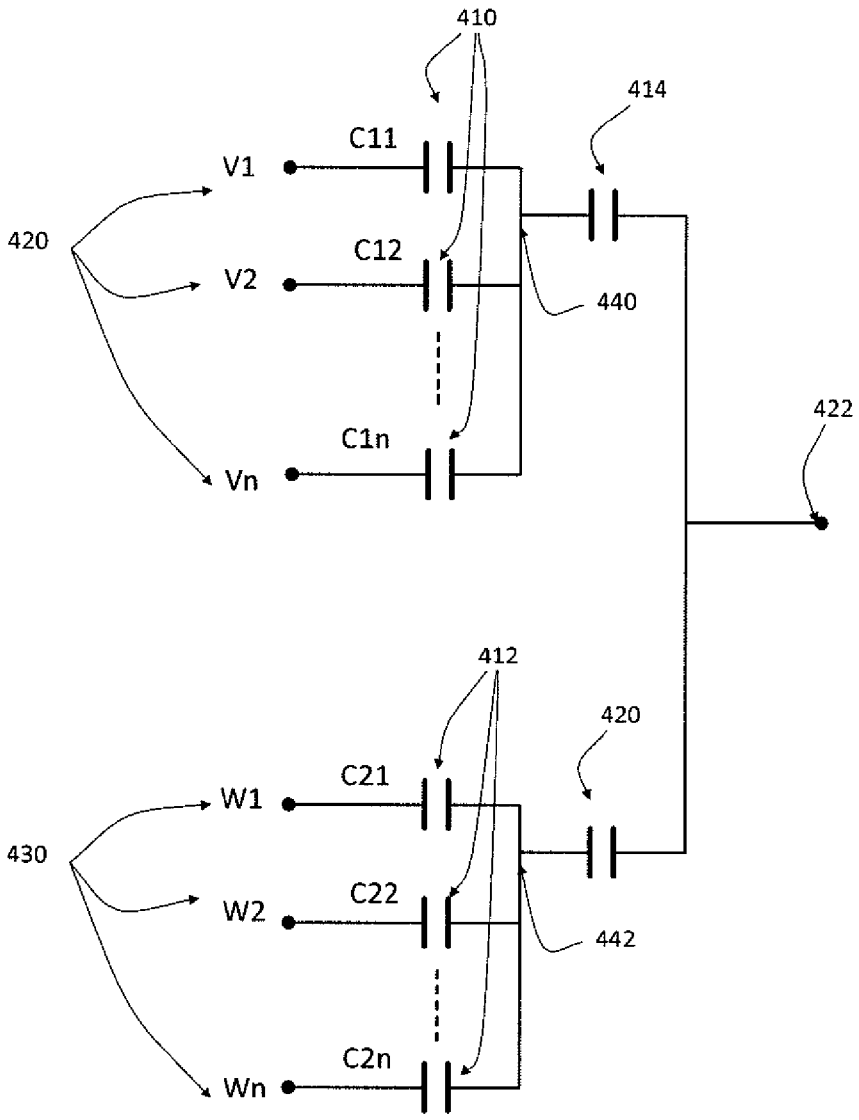
FIG. 4 is a schematic diagram showing an example analog circuit having inputs that may take on binary values in accordance with at least one embodiment of the invention.

In accordance with at least one embodiment of the invention FIG. 4 shows the inputs of capacitors 414 and 420 are each connected to a set of n capacitors. Components 414, 420 and 422 of FIG. 4 correspond to components 114, 120 and 122 of FIG. 1, respectively. The input voltages are connected to capacitors of values $C_{12}, \ldots C_{1n}$, respectively. The input voltages are connected to capacitors of values $G_{21}, \ldots, C_{2n}$, respectively. In preferred embodiments the following holds:

$$\Sigma_{i=1}^{n} C_{1i} = C \text{ and } \Sigma_{i=1}^{n} C_{2i} = C \qquad \text{[Equation 6]}$$

where C is a capacitance that may be chosen according to the application. In the embodiment of FIG. 4, the inputs $V_1, \ldots, V_n$ and $W_1, \ldots, W_n$ may take on binary values. The two states may be for instance 0V (zero volts) and 1.0V (one volt). The capacitances $C_{1i}$ and $C_{2i}$ can be chosen as scaled powers of two and this allows capacitors 410, 412 to perform a digital-to-analog (DA) conversion from the digital $V_1, \ldots, V_n$ and $W_1, \ldots, W_n$ to an output voltage at nodes 440 and 442, respectively. These output voltages are subsequently multiplied by the respective actions of capacitors 414, 420, and the results accumulated at output node 422, in an operation corresponding to that of Equation 1.

Figure 5A:
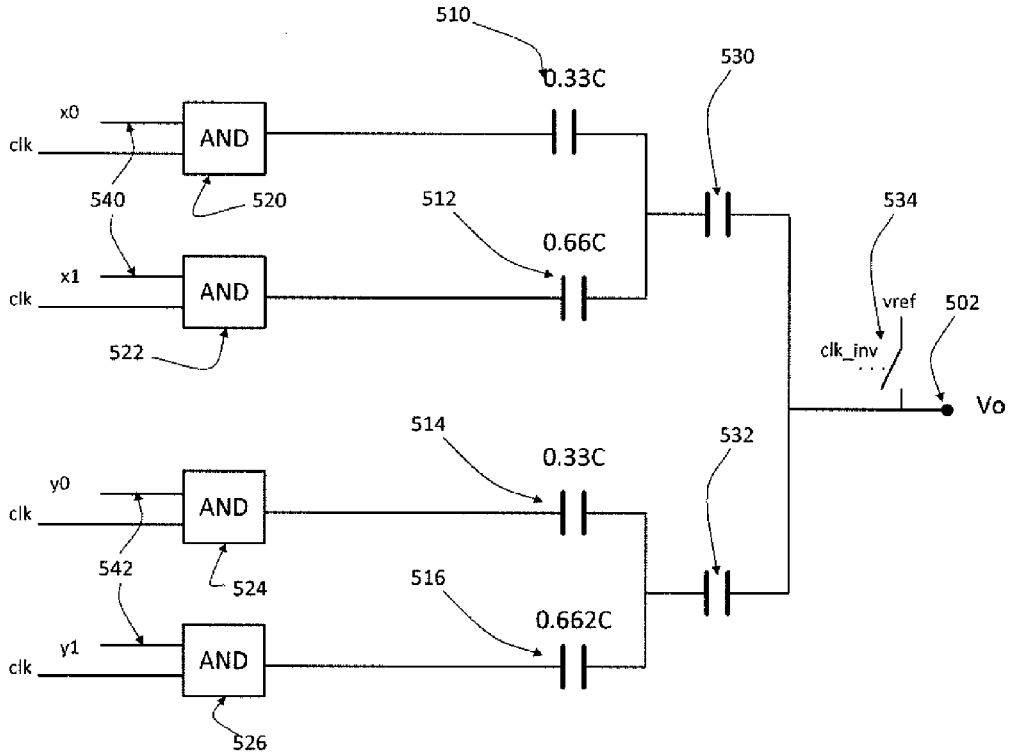
FIG. 5*a* is a schematic diagram showing an example analog circuit including digital-to-analog conversion at the inputs of a MAU network in accordance with at least one embodiment of the invention.
Figure 5B:
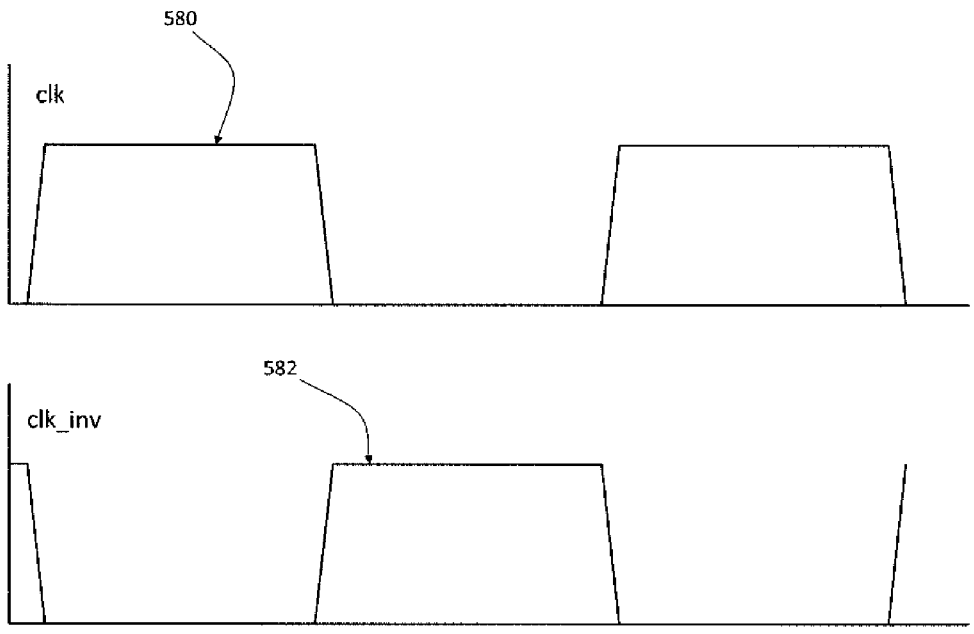
FIG. 5*b* is a timing diagram corresponding to an example operation of the circuit of FIG. 5*a*.

FIG. 5*a* illustrates how two sets of bits $(x_1,x_0)$ and $(y_1,y_0)$ may be converted to analog and subsequently be multiplied by coefficients $b_1$ and $b_2$ in accordance with at least one embodiment of the invention. In FIG. 5*a* the two pairs of input bits 540, 542 are connected to conventional AND logic gates 520, 522, 524, 526. During the pre-charge phase the switch 534 is closed and the output node is pre-charged to a reference voltage. Furthermore, the clk inputs of the AND gates are low and the binary values $x_1$, $x_0$, $y_1$, $y_0$ are set to either a logical 0 or 1. The output of the AND gates are connected to capacitors 510, 512, 514, 516. At some moment in time switch 534 opens and the clk signal may become high. This initializes the outputs of the AND gates to be equal to their first input which is one of the bits $x_1$, $x_0$, $y_1$, $y_0$. The output voltage V at node 502 now becomes equal to:

$$V = \frac{1}{Z}\left(\frac{a_1}{1+a_1}(x_0+2x_1) + \frac{a_2}{1+a_2}(y_0+2y_1)\right) \qquad \text{[Equation 7]}$$

where $a_1$ and $a_2$ depend on the values of capacitors 530 and 532 as described above. This performs an DA conversion of the bits $(x_1,x_0)$ and $(y_1,y_0)$ and the result is multiplied by coefficients $b_1=a_1/(1+a_1)$ and $b_2=b_2/(1+b_2)$. The effect of the voltage value corresponding to the logical bits can be observed into the normalization constant Z. As will be apparent to one of skill in the art, this example may be extended to multiple input bits or a final accumulate operation with more than two operands. A timing diagram for switch 534 and the input signal elk to the AND gates is shown in FIG. 5*b*. In accordance with at least one embodiment of the invention, the waveform 580 and 582 may be non-overlapping.

Figure 6:
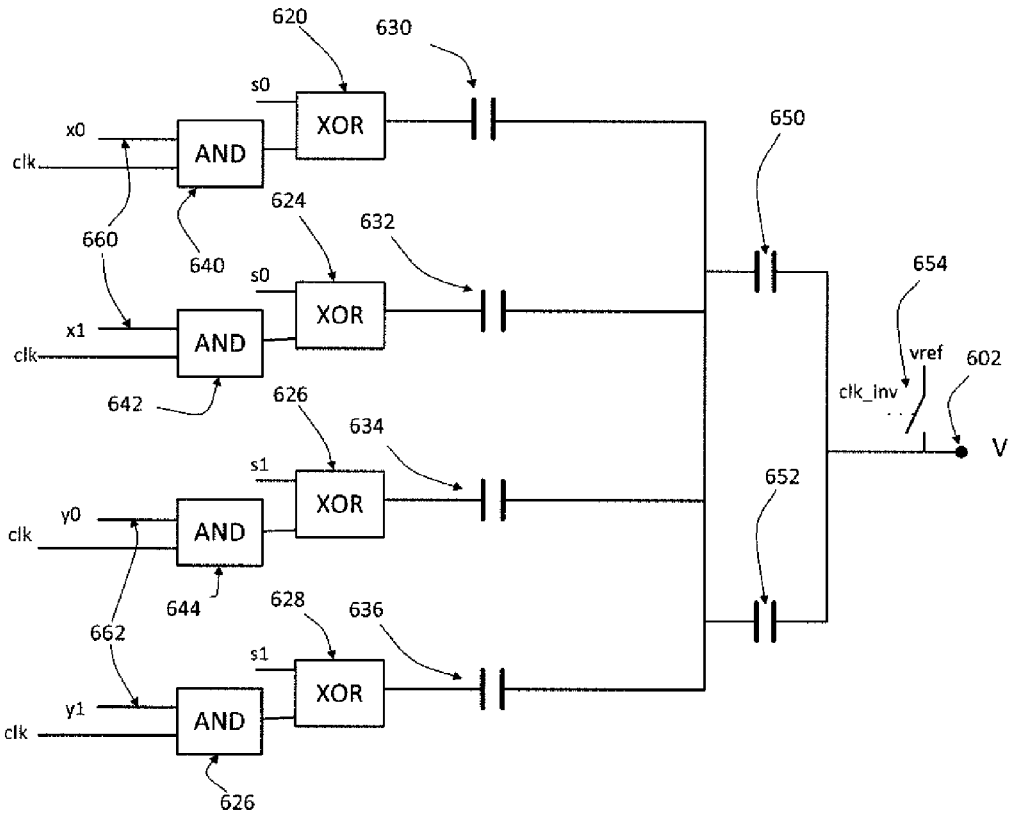
FIG. 6 is a schematic diagram showing another example analog circuit incorporating XOR gates in accordance with at least one embodiment of the invention.

In accordance with at least one embodiment of the invention the circuit of FIG. 5*a* may be extended as shown in FIG. 6 to include conventional XOR (exclusive or) logic gates 620, 624, 625 and 628. One input of each XOR gates is the output of the AND gates and the other input is connected to bits $s_0$ and $s_1$, which can be viewed as sign bits for the pairs of bits $(x_0, x_1)$ and $(y_0, y_1)$ respectively. During the time that the elk signal is low the bits $s_0$, $s_1$ determine the voltage at the left plate of capacitors 630, 632, 634 and 636. Once the clk signal goes high the outputs of the XOR gates will switch either from high to low or from low to high for the input bits that are high. The direction of switching is determined by the value of the respective sign bit $s_0$ and $s_1$. In this way the output voltage V can have both positive and negative swings around the reference voltage vref. Components 602, 630, 632, 634, 636, 640, 642, 644, 646, 650, 652, 654, 660 and 662 of FIG. 6 correspond to components 502, 510, 512, 514, 516, 520, 522, 524, 526, 530, 532, 534, 540 and 542 of FIG. 5*a*, respectively.

Figure 7:
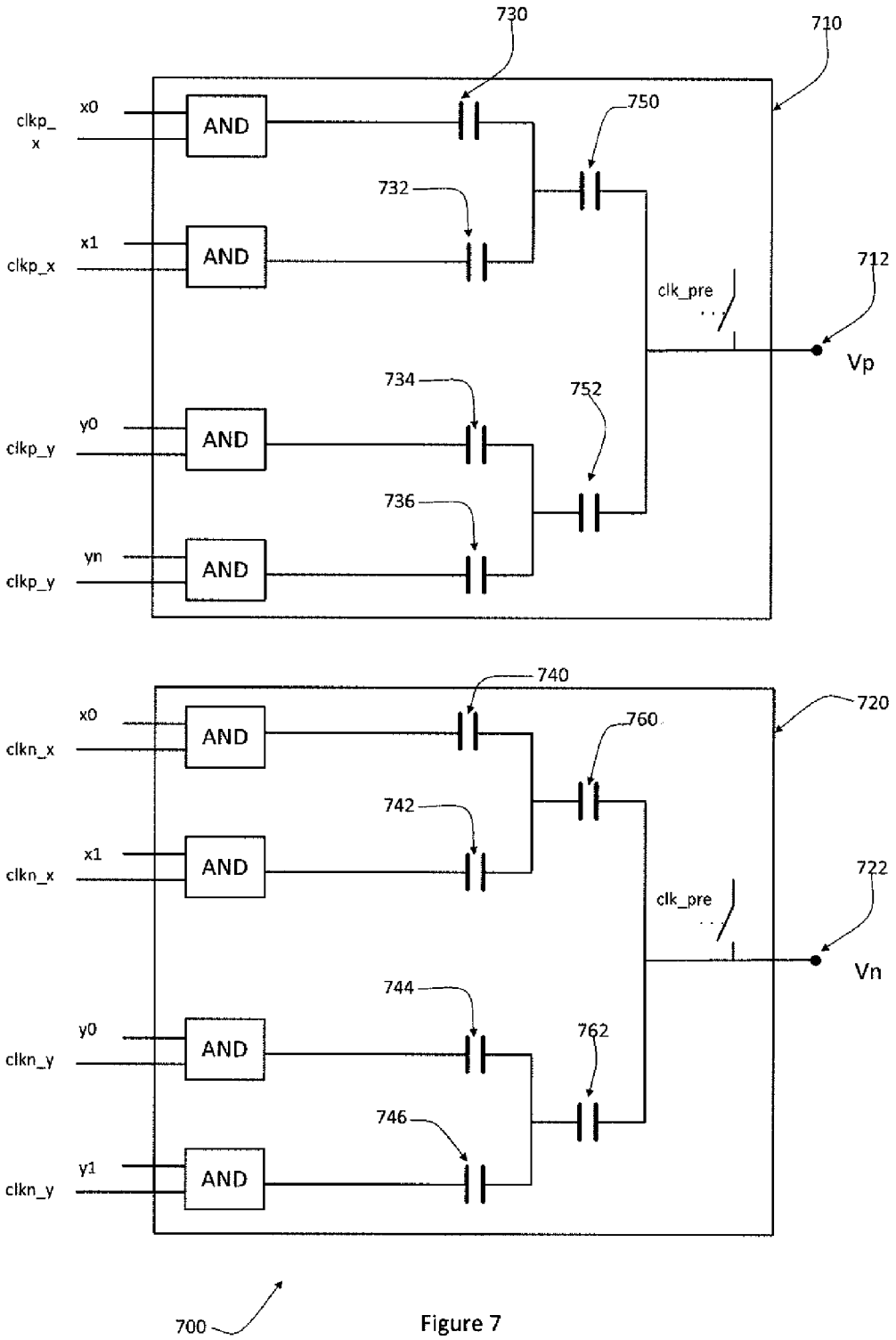
FIG. 7 is a schematic diagram showing an example analog circuit providing differential outputs in accordance with at least one embodiment of the invention.

An example differential signal output circuit 700 in accordance with at least one embodiment of the invention is shown in FIG. 7. It includes two multiply accumulate units 710 and 720 with output nodes 712 and 722, respectively. The input of each of the multiply accumulate units 710 and 720 are the two pairs of bits $(x_0,x_1)$ and $(y_0,y_1)$. The capacitances of capacitors 730, 732, 734 and 736 are $C_1$, $C_2$, $C_3$ and $C_4$, respectively. The capacitances of capacitors 740, 742, 744 and 746 are $C_5$, $C_6$, $C_7$ and $C_8$, respectively. The capacitances of 750, 752, 760, 762 are denoted by $D_1$, $D_2$, $D_3$, $D_4$, respectively. There are two output nodes, with the voltage of output node 712 denoted by $V_p$ and the voltage of output node 722 denoted by $V_n$. In accordance with at least one embodiment of the invention, capacitances $C_1$, $C_2$ and $C_3$, $C_4$ and $C_4$, $C_5$ and $C_6$, $C_7$ are chosen as $C_1+C_2=C$, $C_3+C_4=C$, $C_5+C_6=C$, $C_7+C_8=C$ and capacitances $D_1$, $D_2$, $D_3$, $D_4$ are chosen as $D_1=a_1C$, $D_2=a_2C$, $D_3=a_3C$, $D_4=a_4C$, where again, C is a suitable base capacitance (e.g., suitable for a particular application) and $a_1$, $a_2$, $a_3$ and $a_4$ are the ratios that yield $D_1$, $D_2$, $D_3$ and $D_4$.

Figure 8:
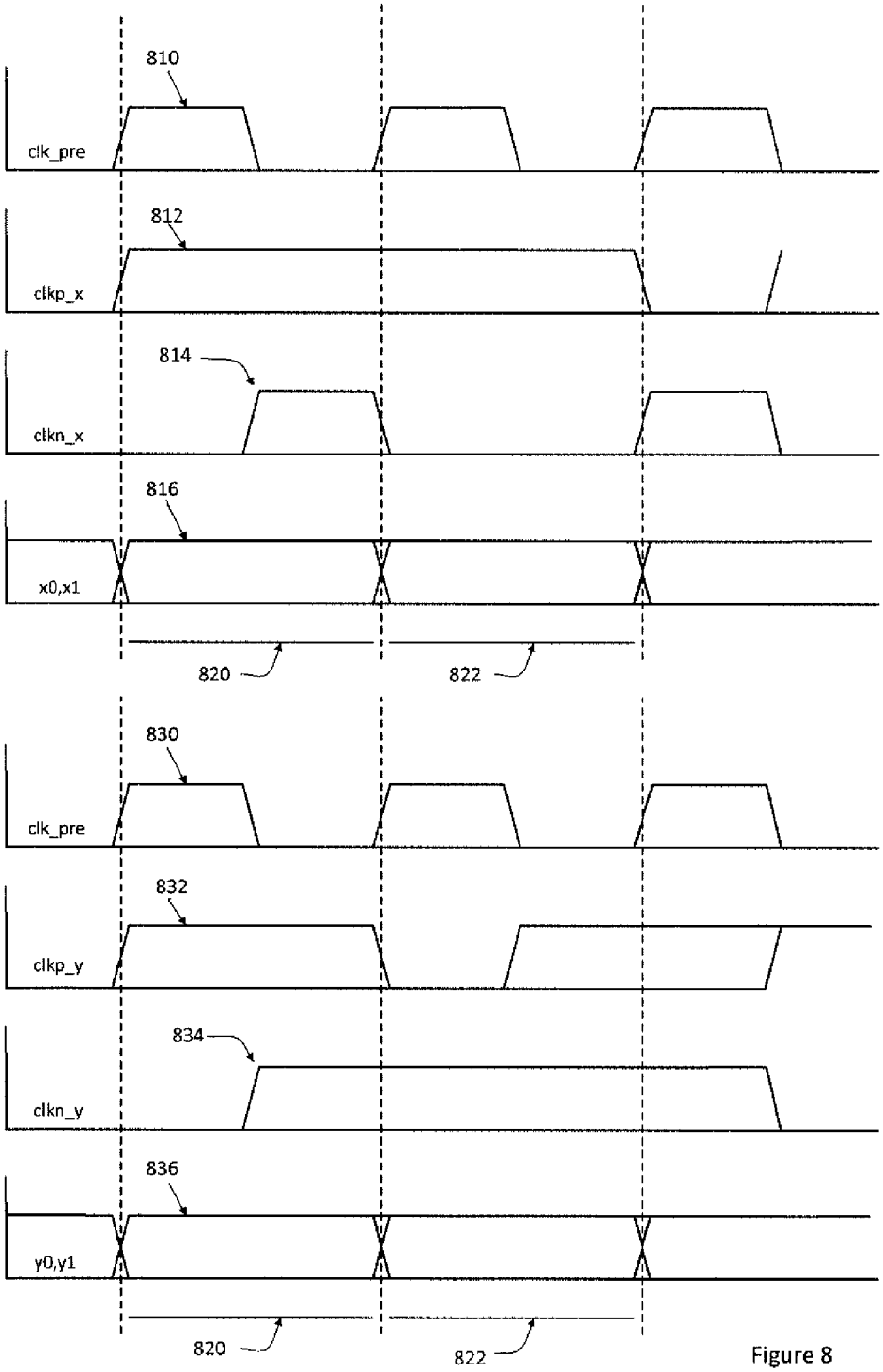
FIG. 8 is a timing diagram corresponding to an example operation of the circuit of FIG. 7.

Multiply accumulate unit 710 has as control signals clkp_x and clkp_y and multiply accumulate unit 720 has control signals clkn_x and clkn_y. The sign of the contribution of $(x_0, x_1)$ to the differential output voltage $V_p-V_n$ is determined by the timing of clkp_x and clkn_x. In a similar way, the sign of the contribution of $(y_0, y_1)$ to the differential output voltage $V_p-V_n$ is determined by the timing of clkp_y and clkn_y. A corresponding example timing diagram is shown as FIG. 8. Waveform 816 represents the data that is constant during the clock cycles and changes on clock cycle boundaries. Two full cycles are shown in FIG. 8, denoted by 820 and 822. The clk_pre signal 810, 830 is high for half the cycles and controls the switches that pre-charge the output nodes 712 and 722. When clk_pre is high the output nodes are pre-charged to a predetermined reference voltage. Depending on the sign that needs to be generated for $(x_0,x_1)$ clkp_x or clkn_x becomes high when clk_pre becomes high. In the first cycle 820 of FIG. 8, clkp_x becomes high when clk_pre become high. During the second half of the cycle when clk_pre becomes low, the connection of the reference voltage to the output nodes is broken. Furthermore, clkn_x becomes high and therefore initiating a charge redistribution and contribution to only output node $V_n$ which effectively creates a negative contribution to the differential output voltage.

In accordance with at least one embodiment of the invention, an advantage of such differential operation is that any supply noise present on the physical voltage values of $(x_0,x_1)$ and $(y_0,y_1)$ is attenuated.

Figure 9:
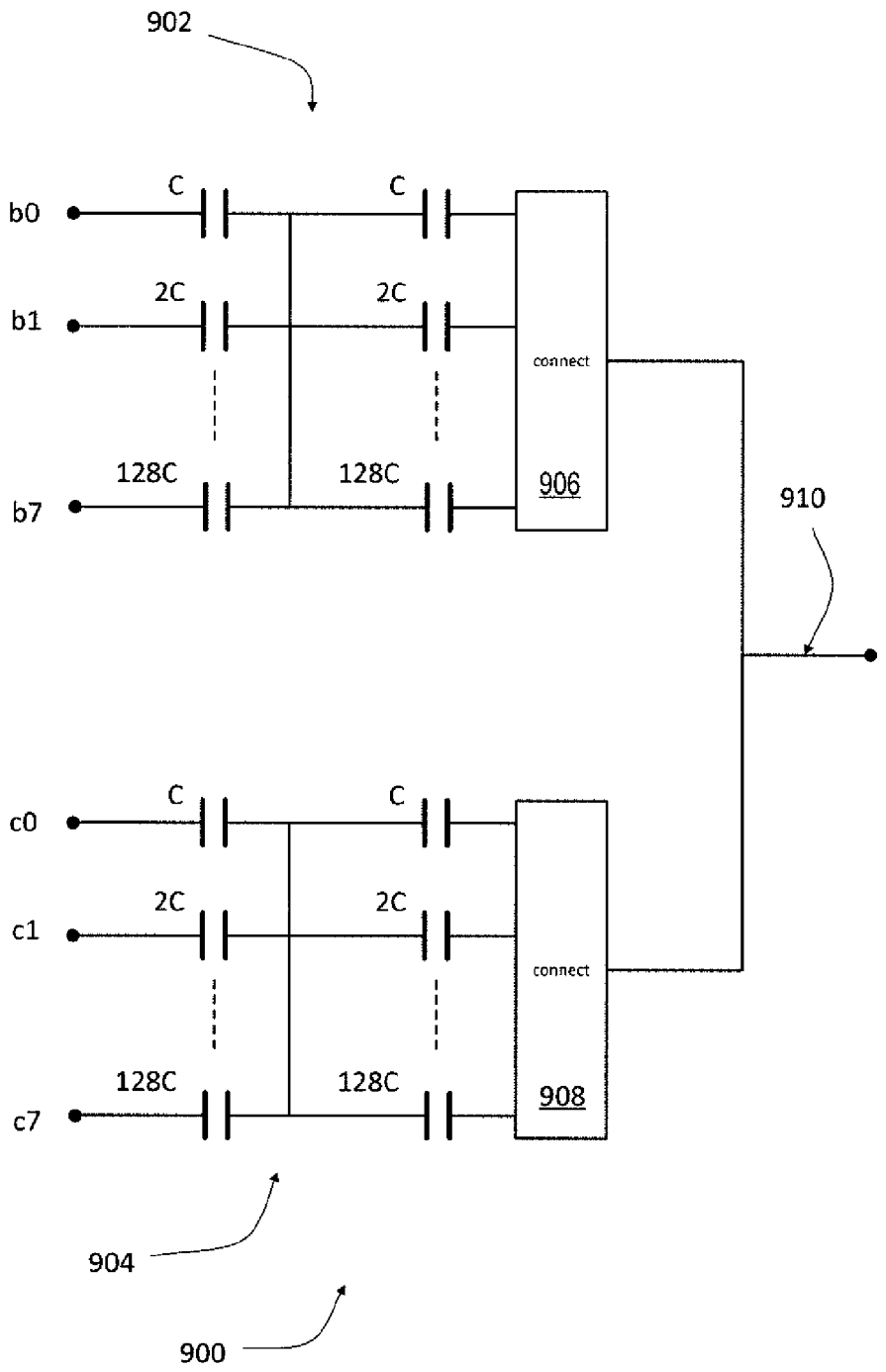
FIG. 9 is a schematic diagram showing an example analog circuit incorporating binary-weighted capacitors on MAU inputs in accordance with at least one embodiment of the invention.

In accordance with at least one embodiment of the invention the architecture of FIG. 1 may be extended such that the capacitors 110,112 and 114 are binary weighted to allow for e.g. digital to analog conversion of input values to a MAU, or multiplication within a MAU by a programmable coefficient. FIG. 9 shows a corresponding example in accordance with at least one embodiment of the invention. A first set of capacitors 902 is configured in a binary weighted network with inputs $b_0, \ldots b_7$. A second set of capacitors 904 is also configured in a binary weighted network. A connection network 906, 908 that may or may not be programmable connects a subset of the capacitors to the output node 910. In this example, a DA conversion may be combined with a programmable multiply accumulate operation. As a multiplier value may be represented as a sum of binary-weighted multiplicative components, in accordance with at least one embodiment of the invention, this configuration permits arbitrary multipliers to be synthesized on an operation-by-operation basis, by selection of suitable passive network elements.

As one example in accordance with at least one embodiment of the invention, the circuit 900 of FIG. 9 may be used to implement PAM modulation combined with a finite impulse response (FIR) filter. Some of the input bits $b_0, \ldots, b_7$ may correspond to a binary representation of a PAM constellation symbol for time interval 1. The first set of capacitors performs effectively the DA conversion operation. The second set of capacitors that are connected to the output connection network may implement a FIR filter coefficient. The bits $c_0, \ldots, c_7$ may correspond to a binary representation of a PAM constellation symbol for time interval 2. The capacitors connected to the second connect network may implement another FIR filter coefficient for this time interval.

Figure 10:
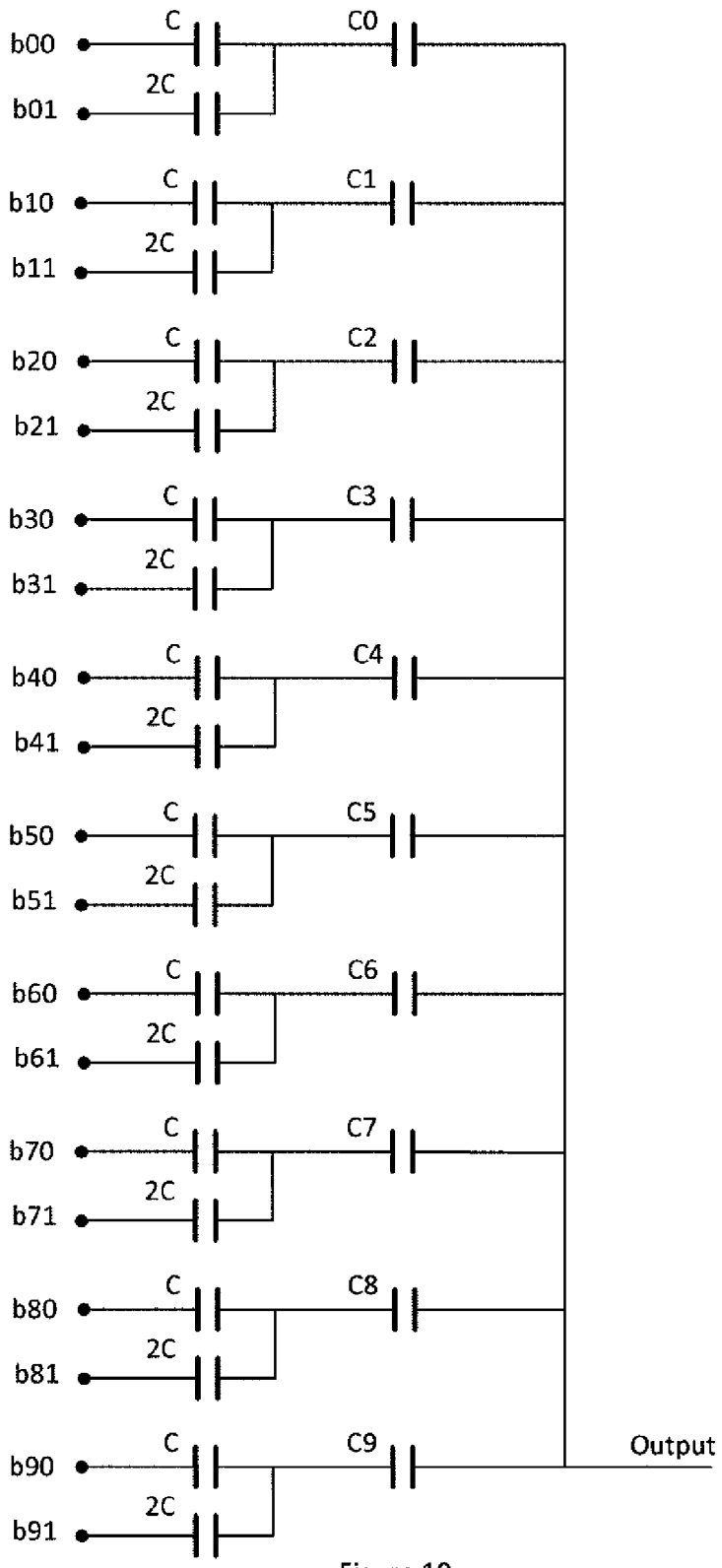
FIG. 10 is a schematic diagram showing an example analog circuit performing modulation and other vector-vector multiply operations in accordance with at least one embodiment of the invention.

In accordance with at least one embodiment of the invention a more general modulate and vector-vector multiply operation may be produced, for example, as shown in FIG. 10. FIG. 10 shows the C and 2C capacitors that implement a 4PAM modulation for the various input bits (i.e., each mapping 2 bits to 4 modulation levels). The output capacitors C0, C1, C2, . . . C9 implement a scaling factor, and the result is summed on the node Output. The specific embodiment in FIG. 10 may be used to implement for instance a row-vector column-vector multiply of a matrix-vector multiplication. In this specific example, the matrix would be a real matrix of size 10 or a complex matrix of size 5. In such a way the computation of the discrete time Fourier transform of size 5 may be implemented.

Figure 11:
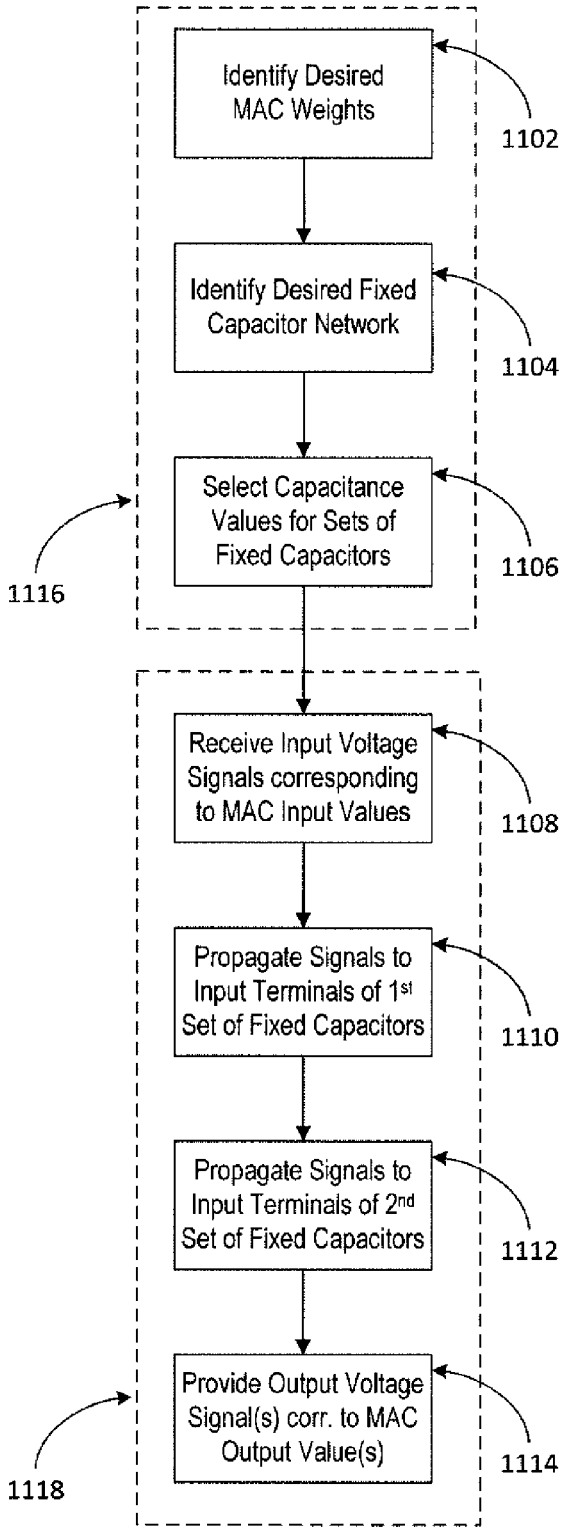
FIG. 11 is a flowchart depicting example steps for multiply accumulate operations in accordance with at least one embodiment of the invention.

The description now turns to example procedures that may be performed in accordance with at least one embodiment of the invention. FIG. 11 depicts example steps for multiply accumulate operations in accordance with at least one embodiment of the invention.

At step 1102, a set of desired multiply accumulate (MAC) weights may be identified. For example, given a set of input voltage signals $V_i$, a set of weights $w_i$ may be identified for a desired multiply accumulate operation with an output voltage signal V that is determined by the equation:

$$V=\Sigma_i w_i V_i \qquad \text{[Equation 8]}$$

At step 1104, a fixed capacitor network for achieving the desired multiply accumulate operation may be identified. For example, one or more of the capacitor networks described above with reference to FIGS. 1-10 may be suitable to achieve the set of desired MAC weights identified at step 1102 (may be candidates), and the fixed capacitor network may be selected based on characteristics of the candidates including component count, performance with respect to noise and power consumption.

At step 1106, capacitance values for sets of capacitors in the fixed capacitor network may be selected. For example, the fixed capacitor network identified at step 1104 may include a first set of capacitors that receive the input voltage signals at their input terminals, and a second set of capacitors, communicatively coupled with the first set, that act as summation nodes in the capacitor network. As described above, the capacitance values for such first and second sets of capacitors may be selected to achieve the MAC weights identified at step 1102.

At step 1108, a set of input voltage signals corresponding to MAC input values may be received. For example, a circuit incorporating the fixed capacitor network identified at step 1104 and having the capacitance values selected at step 1106 may receive the set of input voltage signals. At step 1110, the voltage signals may be propagated to input terminals of a first set of fixed capacitors. For example, the set of voltage input signals may include voltage signals $V_1$, $V_2$, $V_3$ and $V_4$ of FIG. 1, and the set of voltage input signals may be propagated to the first set of fixed capacitors that includes capacitors 110, 112, 116 and 118 of FIG. 1. At step 1112, the voltage signals may be propagated to input terminals of a second set of fixed capacitors. For example, capacitor network voltage signals from the output terminals of capacitors 110, 112, 116 and 118 may be propagated to input terminals of a second set of fixed capacitors including capacitors 114 and 120 of FIG. 1. At step 1114, one or more output voltage signals that correspond to output values of the multiply accumulate operation may be provided. For example, again with reference to FIG. 1, output voltage signals may be propagated from the output terminals of capacitors 114 and 120 to provide the desired output at capacitor network node 122.

In FIG. 11, steps 1102, 1104, 1106 may participate in a pre-implementation or design phase 1116, and steps 1108, 1110, 1112, 1114 may participate in an implementation or operational phase 1118.

All references, including publications, patent applications, and patents, cited herein are hereby incorporated by reference to the same extent as if each reference were individually and specifically indicated to be incorporated by reference and/or were set forth in its entirety herein.

The use of the terms "a" and "an" and "the" and similar referents in the specification and in the following claims are to be construed to cover both the singular and the plural, unless otherwise indicated herein or clearly contradicted by context. The terms "having," "including," "containing" and similar referents in the specification and in the following claims are to be construed as open-ended terms (e.g., meaning "including, but not limited to,") unless otherwise noted. Recitation of ranges of values herein are merely indented to serve as a shorthand method of referring individually to each separate value inclusively falling within the range, unless otherwise indicated herein, and each separate value is incorporated into the specification as if it were individually recited herein. All methods described herein can be performed in any suitable order unless otherwise indicated herein or clearly contradicted by context. The use of any and all examples, or exemplary language (e.g., "such as") provided herein, is intended merely to better illuminate embodiments of the invention and does not pose a limitation to the scope of the invention unless otherwise claimed. No language in the specification should be construed as indicating any non-claimed element as essential to each embodiment of the present invention.

Preferred embodiments are described herein, including the best mode known to the inventors. Further embodiments can be envisioned by one of ordinary skill in the art after reading this disclosure. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. An apparatus for performing a multiply accumulate operation, the apparatus comprising:

multiple inputs configured to receive multiple voltages, each voltage representing one input value to the multiply accumulate function, a fixed capacitor network, comprising two or more first input capacitors, one or more second series capacitors, and one or more result nodes comprising a result node capacitor, wherein the first input capacitors connect each input to one of at least one summation nodes, and the second series input capacitors connecting one or more summation nodes to one of at least one result node, wherein the voltage present on a result node represents a weighted sum of values represented at each connected summation node, the voltage present on each summation node represents a weighted sum of values at each connected input, and the weighted sums represent multiplication of a value by a constant determined by capacitive values in the fixed capacitor network.

2. An apparatus in accordance with claim 1 having at least two result nodes producing differential result outputs.

3. An apparatus for multiply accumulate operations, the apparatus comprising:

a plurality of circuit inputs configured at least to receive a plurality of input voltages, the plurality of input voltages corresponding to input values of a multiply accumulate operation;

at least one circuit output configured at least to provide at least one output voltage, the at least one output voltage corresponding to at least one result of the multiply accumulate operation; and a capacitor network communicatively coupled with the plurality of circuit inputs and the at least one circuit output, the capacitor network including:

a first set of fixed capacitors each configured at least to receive, at an input terminal, a voltage corresponding to one of the input values of the multiply accumulate operation; and a second set of fixed capacitors each having an input terminal communicatively coupled with output terminals of a plurality of the first set of fixed capacitors, the second set of fixed capacitors having a plurality of output terminals communicatively coupled with the at least one circuit output such that the at least one output voltage at the at least one circuit output corresponds to the at least one result of the multiply accumulate operation.

4. An apparatus in accordance with claim 3, wherein the plurality of circuit inputs are configured to receive a plurality of analog input voltages and the at least one circuit output is configured to provide at least one analog output voltage.

5. An apparatus in accordance with claim 3, wherein the at least one result of the multiply accumulate operation corresponds to a weighted sum of the input values.

6. An apparatus in accordance with claim 3, wherein the at least one output voltage corresponds to a weighted sum of the plurality of input voltages.

7. An apparatus in accordance with claim 6, wherein weights of the weighted sum are based at least in part on capacitance values of the first set of fixed capacitors and the second set of fixed capacitors.

8. An apparatus in accordance with claim 3, wherein each capacitor in the second set of fixed capacitors is communicatively coupled with a disjoint subset of the first set of fixed capacitors.

9. An apparatus in accordance with claim 8, wherein the capacitance values of the capacitors in each disjoint subset sum to a same total capacitance.

10. An apparatus in accordance with claim 8, wherein each capacitor in the second set of fixed capacitors corresponds to a summation node in the capacitor network having an input voltage corresponding to a weighted sum of the voltages at the input terminals of the disjoint subset of the first set of fixed capacitors to which the summation node is communicatively coupled.

11. An apparatus in accordance with claim 10, wherein the at least one output voltage corresponds to a weighted sum of the voltages at the input terminals of the summation nodes.

12. An apparatus in accordance with claim 3, wherein the capacitor network comprises a plurality of disjoint sub-networks each communicatively coupled with one of a plurality of circuit outputs such that the at least one result of the multiply accumulate operation corresponds to at least one differential output voltage between the plurality of circuit outputs.

13. An apparatus in accordance with claim 12, wherein each of the plurality of disjoint sub-networks receives a distinct copy of a set of input voltages corresponding to the input values of the multiply accumulate operation.

14. A method for multiply accumulate operations, the method comprising:

receiving, at a plurality of circuit inputs, a plurality of input voltage signals corresponding to input values of a multiply accumulate operation;

propagating each the plurality of input voltage signals to one a plurality of input terminals of a first set of fixed capacitors thereby creating corresponding capacitor network voltage signals at corresponding output terminals of the first set of fixed capacitors; and propagating the capacitor network voltage signals to a plurality of input terminals of a second set of fixed capacitors thereby creating at least one corresponding output voltage signal, the second set of fixed capacitors being communicatively coupled with the first set of fixed capacitors such that the at least one output voltage signal corresponds to at least one result of the multiply accumulate operation.

15. A method in accordance with claim 14, wherein the input voltage signals, the capacitor network voltage signals and the at least one output voltage signal are analog voltage signals.

16. A method in accordance with claim 14, wherein the at least one result of the multiply accumulate operation corresponds to a weighted sum of the input values.

17. A method in accordance with claim 14, wherein the at least one output voltage signal corresponds to a weighted sum of the plurality of input voltage signals.

18. A method in accordance with claim 14, wherein each capacitor in the second set of fixed capacitors receives capacitor network voltage signals from a disjoint subset of the first set of fixed capacitors.

19. A method in accordance with claim 18, wherein each capacitor in the second set of fixed capacitors corresponds to a summation node in a capacitor network such that the capacitor network voltage signals from the disjoint subset of the first set of fixed capacitors that are received at the summation node combine to form a weighted sum of the voltage signals at the input terminals of the disjoint subset of the first set of fixed capacitors.

20. A method in accordance with claim 19, wherein the at least one output voltage signal corresponds to a weighted sum of the voltages at the input terminals of the summation nodes.

* * * * *